US010101104B2

(12) United States Patent
Zheng

(10) Patent No.: US 10,101,104 B2
(45) Date of Patent: Oct. 16, 2018

(54) ADJUSTABLE GAS SYSTEM FOR FIREARMS

(71) Applicant: Jing Zheng, El Paso, TX (US)

(72) Inventor: Jing Zheng, El Paso, TX (US)

( * ) Notice: Subject to any disclaimer, the term of this patent is extended or adjusted under 35 U.S.C. 154(b) by 0 days.

(21) Appl. No.: 15/849,677

(22) Filed: Dec. 21, 2017

(65) Prior Publication Data

US 2018/0180370 A1 Jun. 28, 2018

Related U.S. Application Data

(60) Provisional application No. 62/439,050, filed on Dec. 25, 2016.

(51) Int. Cl.
*F41A 5/28* (2006.01)
*F41A 5/20* (2006.01)
*F41C 23/16* (2006.01)

(52) U.S. Cl.
CPC *F41A 5/28* (2013.01); *F41A 5/20* (2013.01); *F41C 23/16* (2013.01)

(58) Field of Classification Search
CPC ..... F41A 5/28
USPC ..... 89/193
See application file for complete search history.

(56) References Cited

U.S. PATENT DOCUMENTS 8,869,674 B2 * 10/2014 Ruck ..... F41A 5/28 89/193
2014/0076150 A1 * 3/2014 Brinkmeyer ..... F41A 5/28 89/193

* cited by examiner

*Primary Examiner* — Reginald S Tillman, Jr.
(74) *Attorney, Agent, or Firm* — Han IP PLLC; Andy M. Han

(57) ABSTRACT

An adjustable gas system for a firearm includes a gas block, a gas regulator and a plunger. The gas block is configured to be fixed to a barrel of the firearm, and includes a hole configured to receive a gas tube of the firearm. The gas regulator is configured to rotate around the barrel, and includes a plurality of gas port holes of different sizes. The plunger is configured to hold the gas regulator at one of a plurality of angles with respect to the gas block such that a select one of the plurality of gas port holes is aligned with the hole on the gas block to allow a respective amount of gas to flow from the barrel to the gas tube through the select one of the plurality of gas port holes.

20 Claims, 8 Drawing Sheets

ADJUSTABLE GAS SYSTEM FOR FIREARMS

CROSS REFERENCE TO RELATED PATENT APPLICATION

The present disclosure claims the priority benefit of U.S. Provisional Patent Application No. 62/439,050, filed 25 Dec. 2016, the content of which is herein incorporated by reference in its entirety.

TECHNICAL FIELD

The present disclosure generally relates to firearms. More specifically, the present disclosure relates to an adjustable gas system for firearms.

BACKGROUND

The term "gas-operation system" in the context of firearms generally refers to a system of operation used to provide energy to operate auto-loading firearms. In gas-operation, a portion of high pressure gas from the cartridge being fired is used to power a mechanism to perform the following operations: (1) extracting the spent casing, and (2) chambering a new cartridge. For example, in a firearm based on the AR-15 platform, there is usually a small gas port, or small hole, in the barrel that vents gas with every shot. In a "direct impingement" gas system, the vented gas travels through a gas block and gas tube into the receiver, where the gas powers the bolt carrier group (BCG) and auto-cycles the next round. In a "piston-operated" or "piston-stroke" system, the vented gas acts upon a face of a piston, which in turn moves the BCG to extract the spent casing and chamber a new cartridge.

Usually, the gas system is tuned to one specific ammunition of certain caliber to work the best in a typical environmental condition and certain firearm configuration. This is what is called a fixed gas system. The advantage of this system is that it is light weight, has fewer parts, and is very reliable if the working condition and firearm configuration are correct. A typical example of such system is on AR-15 rifles, a civilian variant of the military version of M16/M4 rifle. However, as environmental condition changes and/or as the firearm configuration changes, or simply because the firearm is not assembled right, the firearm could experience what is called an over-gas situation or an under-gas situation.

The over-gas situation tends to happen when the firearm is used in conjunction with a silencer, or some kind of recoil reduction muzzle device, such that the back pressure generated by such device would add the gas pressure to the gas system. As such, the bolt carrier group tends to move back faster with more energy. Given a weak extractor spring, the extractor may run over the rim of the spent casing and leave it stuck inside the chamber, thus resulting in jamming the firearm, when the BCG travels back and reloads the next round. Moreover, a so-called "felt recoil" may result, and the firearm may be put under more stress and hence its service life may be shortened.

The under-gas situation tends to happen when the firearm gets dirty, or when the environment is very cold such that the system does not have enough gas energy to recycle the firearm. As such, the BCG either may not move back enough to either eject the spent casing or may fail to load the next round, thus resulting in jamming the firearm.

SUMMARY

The present disclosure proposes a novel design of an adjustable gas system that allows different amounts of gas to return to the firearm receiver so that different amounts of energy could be transferred to the bolt carrier group (BCG) so that it would work properly in different kinds of situations and firearm conditions.

In one aspect, an adjustable gas system for a firearm may include a gas block, a gas regulator and a plunger. The gas block may be configured to be fixed to a barrel of the firearm, and may include a hole configured to receive a gas tube of the firearm. The gas regulator may be configured to rotate around the barrel, and may include a plurality of gas port holes of different sizes. The plunger may be configured to hold the gas regulator at one of a plurality of angles with respect to the gas block such that a select one of the plurality of gas port holes is aligned with the hole on the gas block to allow a respective amount of gas to flow from the barrel to the gas tube through the select one of the plurality of gas port holes.

In another aspect, an apparatus may include a firearm and the aforementioned adjustable gas system. The firearm may include at least a barrel and a gas tube, with the adjustable gas system mounted on the barrel.

These and other objectives of the present disclosure will be appreciated by those of ordinary skill in the art after reading the following detailed description of the preferred embodiments that are illustrated in the various figures and drawings.

BRIEF DESCRIPTION OF THE DRAWINGS

The accompanying drawings are included to provide a further understanding of the disclosure, and are incorporated in and constitute a part of the present disclosure. The drawings illustrate embodiments of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF THE PREFERRED EMBODIMENTS

Overview

Figure 1:
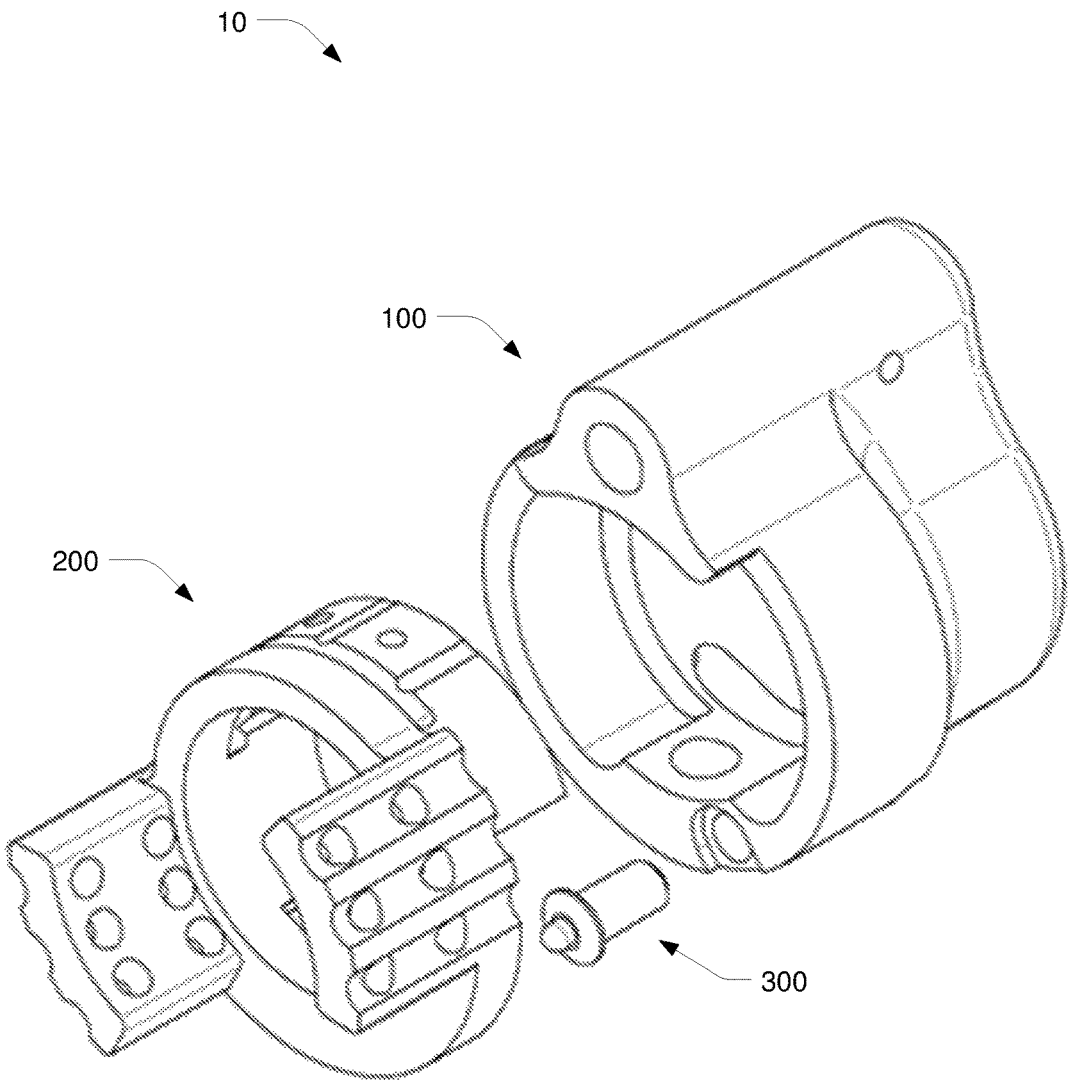
FIG. 1 is an exploded view of an adjustable gas system in accordance with an embodiment of the present disclosure.

Various embodiments of the present disclosure relate to an adjustable gas system for firearms. The proposed design utilizes a set of different sized holes to allow different amounts of gas to move the BCG in an optimum speed and achieve optimum amount of backward displacement.

Reference will now be made in detail to the preferred embodiments of the present disclosure, examples of which are illustrated in the accompanying drawings. Wherever possible, the same reference numbers are used in the drawings and the description to refer to the same or like parts.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator of the firearm. The same convention applies for the direction statements used herein.

For illustrative purposes and without limiting the scope of the present disclosure, two different designs of external features and ways of securing an adjustable gas system to the barrel of a firearm are presented herein. That is, a first example design in accordance with the present disclosure is embodied in an adjustable gas system 10, shown in FIGS. 1-4, and a second example design in accordance with the present disclosure is embodied in an adjustable gas system 20, shown in FIGS. 5-8. Adjustable gas system 10 may be considered as a pin-on type of adjustable gas system that utilizes a pin method for securing or otherwise attaching adjustable gas system 10 to a barrel 50 of a firearm, as shown in FIG. 4. Adjustable gas system 20 may be considered as a clamp-on type of adjustable gas system that utilizes a clamp method for securing or otherwise attaching adjustable gas system 20 to barrel 50 of a firearm, as shown in FIG. 8. Each of adjustable gas system 10 and adjustable gas system 20 is described in detail below with reference to respective figures. It is noteworthy that different numeral references are used in the figures for different components, and identical numeral references are used in the figures for components that are identical or substantially similar.

FIG. 1 illustrates an exploded view of adjustable gas system 10 in accordance with the present disclosure. The adjustable gas system 10 may include three major parts, namely: a gas block 100, a gas regulator 200 and a plunger 300. As a pin-on type of gas block, gas block 100 may be fixed to barrel 50 of a firearm with pin and/or other mechanisms. Gas regulator 200 may be rotatable around barrel 50 with limited rotational angles. Plunger 300 may be a spring-loaded round-nosed position device configured to hold gas regulator 200 in a certain angle while still allowing the rotational capability of gas regulator 200. In some implementations, plunger 300 may be made of steel, metal alloy or any other suitable material.

Figure 2:
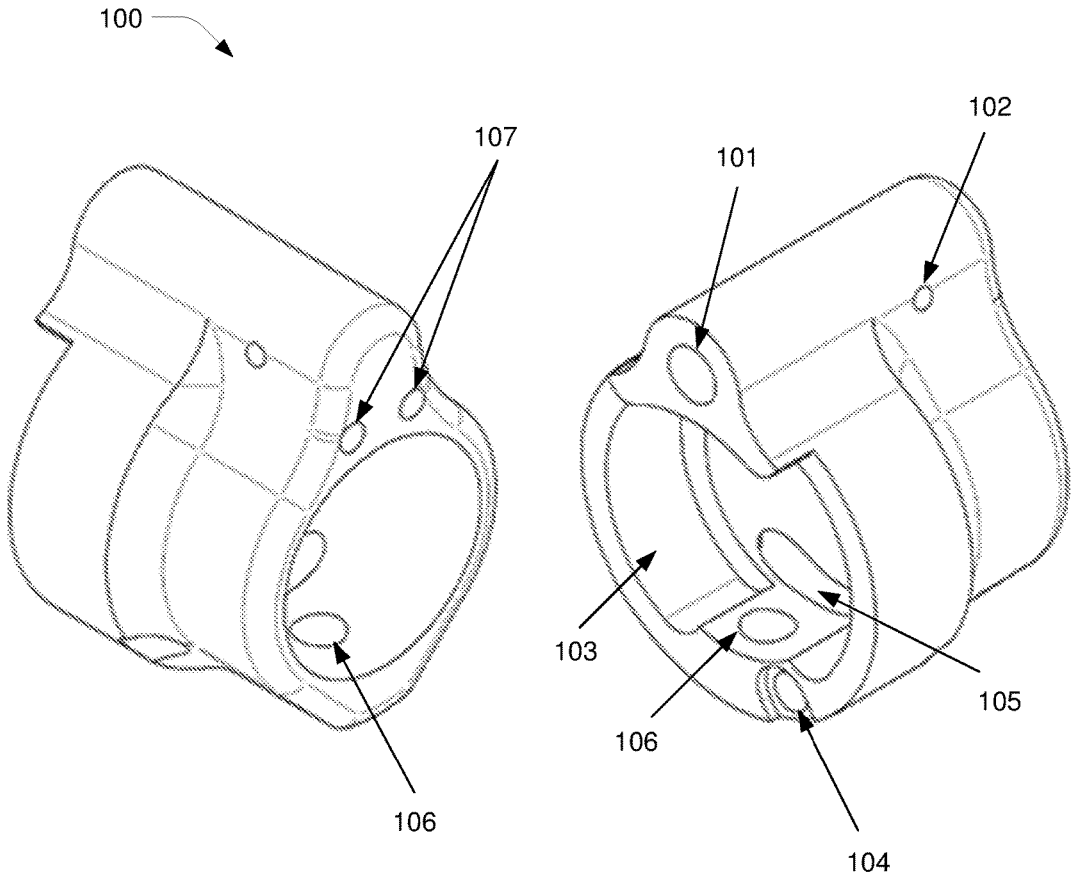
FIG. 2 shows front and back isometric views of a gas block body of an adjustable gas system in accordance with an embodiment of the present disclosure.

FIG. 2 illustrates front and back isometric views of gas block 100 in accordance with the present disclosure. Referring to FIG. 2, gas block 100 may include a gas tube cavity 101, a pin hole 102, a cavity 103, a plunger hole 104, a pin hole 105, two threaded holes 106, and two gas and debris ventilation holes 107. Gas tube cavity 101 may be configured to receive a gas tube of the firearm for gas to flow through gas block 100. Pin hole 102 may be configured to receive a gas tube pin of the gas tube that would fix the gas tube to gas block 100. Cavity 103 may be configured to at least partially receive gas regulator 200 therein. Plunger hole 104 may be configured to receive plunger 300 therein. Thus, plunger 300 may be retractably received in plunger hole 104 on the gas block 100. Pin hole 105 may be configured to fix gas block 100 to barrel 50 of the firearm. Threaded holes 106 may be configured to receive or otherwise accommodate screws to fix gas block 100 to barrel 50 of the firearm. Gas and debris ventilation holes 107 may be configured to ventilate escaped gas and debris within the system due to gaps between parts of the firearm and adjustable gas system 10.

Figure 3:
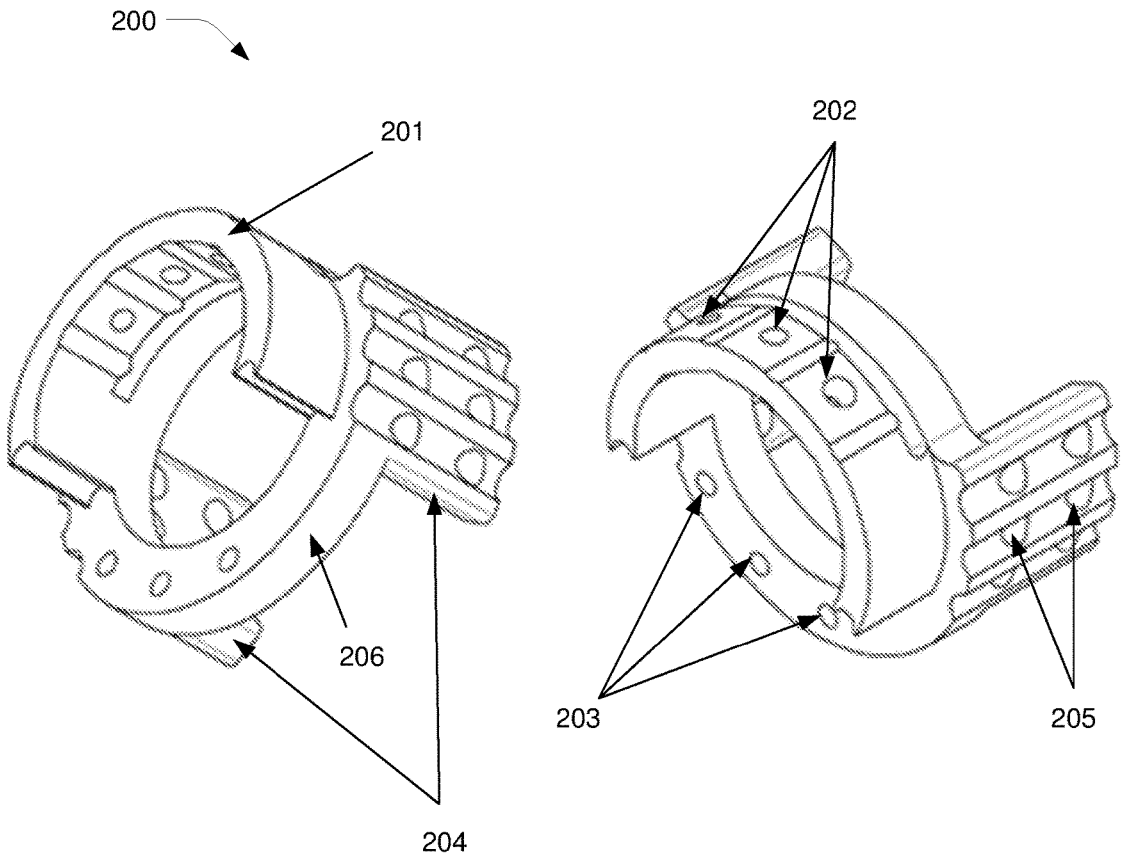
FIG. 3 shows two different isometric views of a gas regulator of an adjustable gas system in accordance with an embodiment of the present disclosure.
Figure 4:
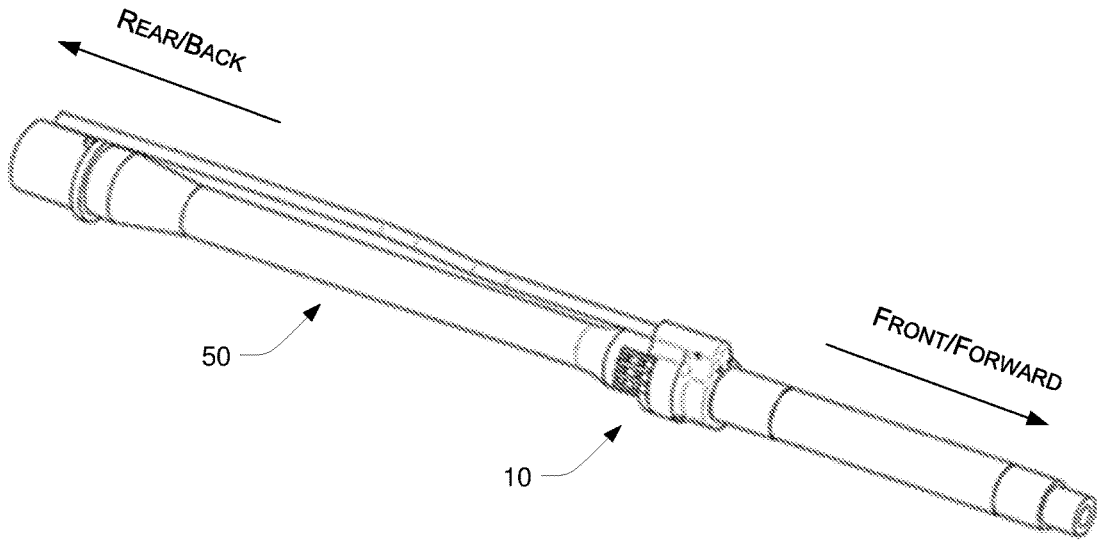
FIG. 4 is a perspective view of an adjustable gas system on a firearm barrel in accordance with an embodiment of the present disclosure.

FIG. 3 illustrates two different isometric views of gas regulator 200 in accordance with the present disclosure. Referring to FIG. 3, gas regulator 200 may include a shaft lip 201, gas port holes 202, plunger nose holes 203 (which may be recesses or blind holes), two ear portions 204, holes 205, and a ring portion 206. Shaft lip 201 may protrude from ring portion 206 in one direction (e.g., toward the front of a firearm when adjustable gas system 10 is installed on barrel 50 of the firearm) while ear portions 204 may protrude from ring portion 206 in an opposite direction (e.g., toward the rear of the firearm when adjustable gas system 10 is installed on barrel 50 of the firearm). Shaft lip 201 may be where gas port holes 202 are located. Shaft lip 201 may be received in cavity 103 of gas block 100. Shaft lip 201 may be curved to accommodate an outer circumference of barrel 50 of the firearm such that, when adjustable gas system 10 is installed on barrel 50, shaft lip 201 at least partially shrouds around barrel 50 of the firearm. In some implementations, as shown in FIG. 3, there may be a plurality of grooves cut or otherwise formed on an outer circumferential surface and/or an interior circumferential surface of shaft lip 201 to make rooms for carbon buildup inside gas block 100.

Gas port holes 202 may be holes in different sizes. Plunger nose holes 203 may be corresponding holes configured to receive the nose of plunger 300. The location of each of the plunger nose holes 203 may correspond to a respective one of the gas port holes 202 such that, when a nose of plunger 300 is received in one of the plunger nose holes 203, one of the gas port holes 202 is aligned with gas tube cavity 101 to allow a respective amount of gas to flow from barrel 50 to the gas tube. Ear portions 204 may be twisted by a user or operator of the firearm to select which one of gas port holes 202 to be used. Ear portions 204 may have grooves thereon to aid gripping by the user or operator of the firearm. Holes 205 may be configured to receive a bullet tip of an ammunition cartridge or a pointy tool (e.g., a hex key) used by the user or operator of the firearm to twist or otherwise rotate gas regulator 200 in order to change from one of the gas port holes 202 of one size to another of the gas port holes 202 of another size. Holes 205 may also be helpful when adjustable gas system 10 is sitting inside a free-floating handguard, such that gas regulator 200 can only be rotated by the tip of a bullet or a pointy tool through ventilation hole(s) on the handguard.

Figure 5:
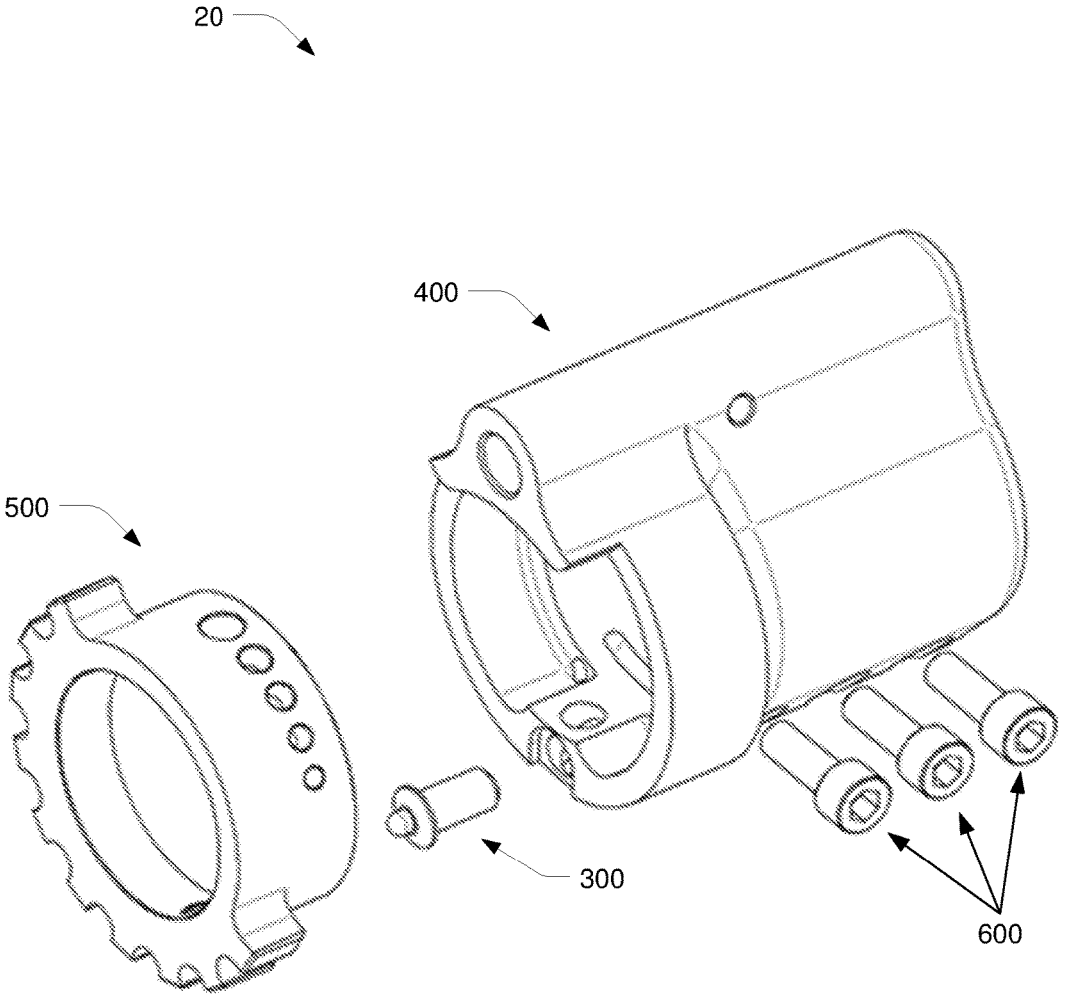
FIG. 5 is an exploded view of an adjustable gas system in accordance with an embodiment of the present disclosure.

FIG. 5 illustrates an exploded view of adjustable gas system 20 in accordance with the present disclosure. The adjustable gas system 20 may include three major parts, namely: a gas block 400, a gas regulator 500 and a plunger 300. As a clamp-on type of gas block, gas block 400 may be fixed to barrel 50 of a firearm with a clamp mechanism which may include one or more (e.g., two or three) clamp socket screws 600. Gas regulator 500 may be rotatable around barrel 50 with limited rotational angles. Plunger 300 may be a spring-loaded round-nosed position device configured to hold gas regulator 500 in a certain angle while still allowing the rotational capability of gas regulator 500. In some implementations, plunger 300 may be made of steel, metal alloy or any other suitable material. Compared to gas regulator 200 and plunger 300 in adjustable gas system 10, in adjustable gas system 20 the gas regulator 400 has a simplified design and the plunger 300 is installed in a different position, with one or more clamp socket screws 600 for securely attaching adjustable gas system 20 to barrel 50 of a firearm.

Figure 6:
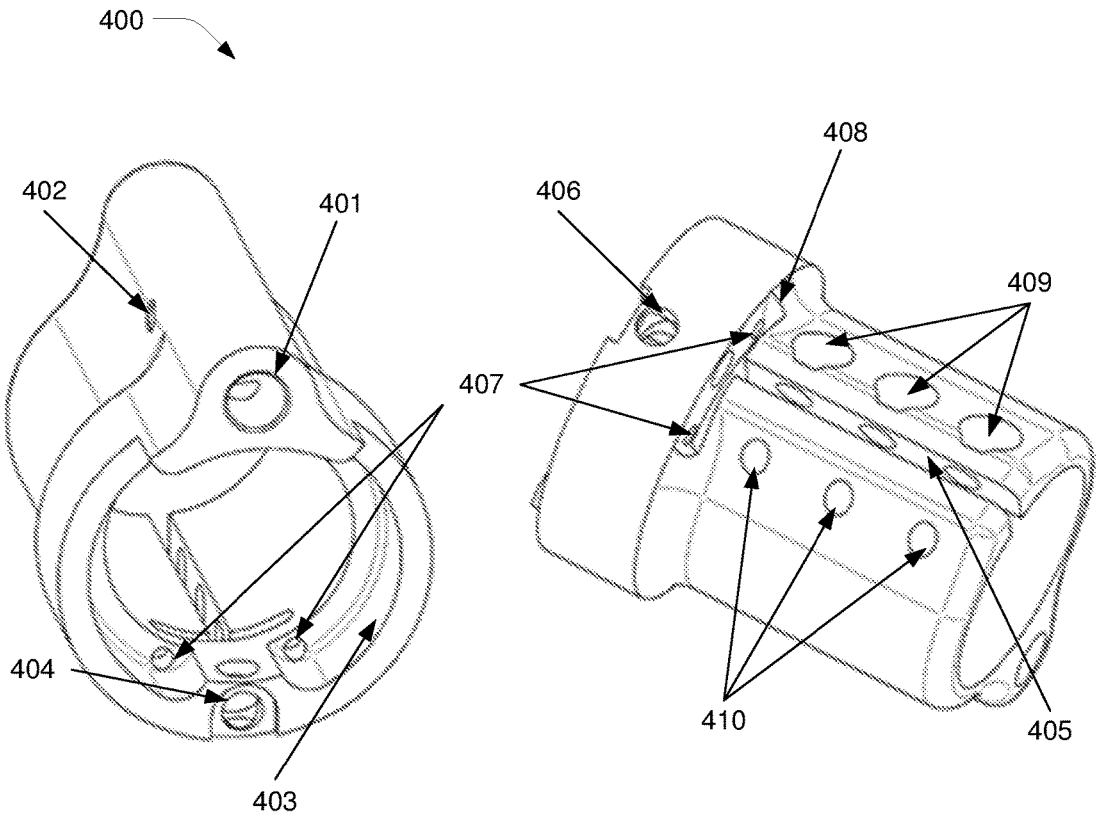
FIG. 6 shows front and back isometric views of a gas block body of an adjustable gas system in accordance with an embodiment of the present disclosure.

FIG. 6 illustrates front and back isometric views of gas block 400 in accordance with the present disclosure. Referring to FIG. 6, gas block 400 may include a gas tube cavity 401, a pin hole 402, a cavity 403, a plunger hole 404, a clamp body cutout 405, a through hole 406, and two gas and debris ventilation holes 407. Gas tube cavity 401 may be configured to receive a gas tube of the firearm for gas to flow through gas block 400. Pin hole 402 may be configured to receive a gas tube pin of the gas tube that would fix the gas tube to gas block 400. Cavity 403 may be configured to at least partially receive gas regulator 500 therein. Plunger hole 404 may be configured to receive plunger 300 therein. Thus, plunger 300 may be retractably received in plunger hole 404 on the gas block 400. Unlike plunger hole 104 on gas block 100, plunger hole 404 is placed on the center line of gas block 400. Clamp body cutout 405 may be configured to provide clearance for clamp socket screw(s) 600 to fasten gas block 400 onto barrel 50 of a firearm. Clamp body through hole 406 may be the clearance drill hole for the drilling of gas port towards gas tube cavity 401. Gas block 400 may also include a stress-relief slot 408 to cope with, minimize or otherwise reduce deformation of gas block 400 due to the force introduced by fastening of the one or more clamp socket screws 600. This feature is essential to keep cavity 403 from deformation which would affect the actuation of gas regulator 500. Compared gas and debris ventilation holes 107 on gas block 100, gas and debris ventilation holes 407 are moved to the bottom of gas block 400 so that escaped gas may be vented out from inside of stress-relief slot 408. This feature is for the ease of manufacturing and the nature of gas and debris flow within the cavity inside gas block 400. Moreover, gas block 400 may include one or more socket screw head clearance holes 409 on one side of gas block 400. Additionally, gas block 400 may include one or more threaded holes 410 on the other side of gas block 400 that correspond to the one or more socket screw head clearance holes 409. Thus, the one or more clamp socket screws 600 may traverse through the one or more socket screw head clearance holes 409 to mate with or otherwise be threaded on the one or more threaded holes 410, thereby clamping gas block 400 onto barrel 50 of a firearm.

Figure 7:
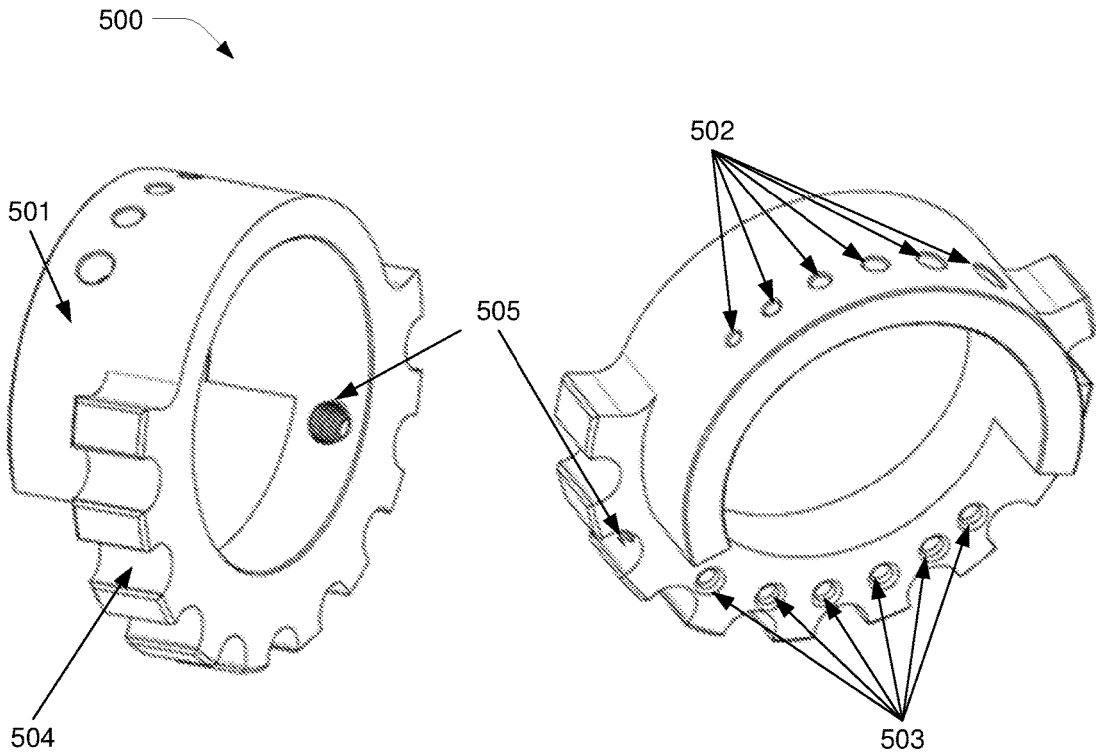
FIG. 7 shows two different isometric views of a gas regulator of an adjustable gas system in accordance with an embodiment of the present disclosure.
Figure 8:
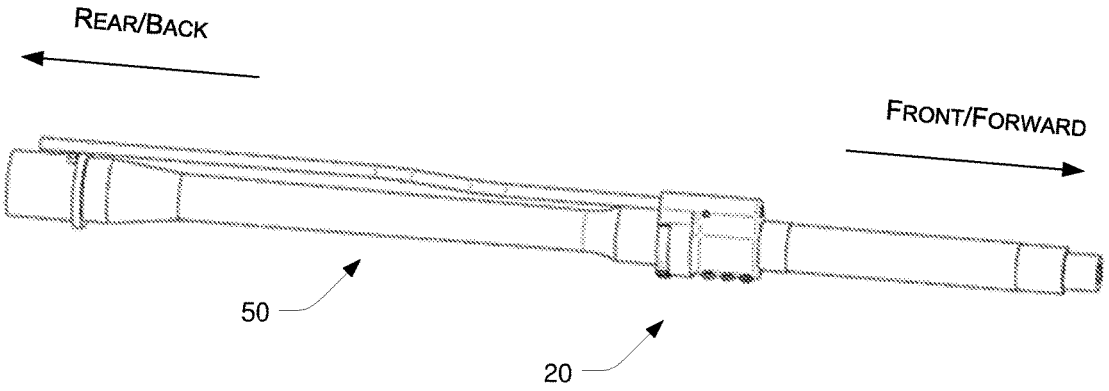
FIG. 8 is a perspective view of an adjustable gas system on a firearm barrel in accordance with an embodiment of the present disclosure.

FIG. 7 illustrates two different isometric views of gas regulator 500 in accordance with the present disclosure. Referring to FIG. 7, gas regulator 500 may include a shaft lip 501, gas port holes 502, plunger nose holes 503 (which may be recesses or blind holes), an adjustment ring 504, and a set screw hole 505. Shaft lip 501 may protrude in a longitudinal direction with respect to barrel 50 of a firearm (e.g., toward the front of the firearm when adjustable gas system 20 is installed on barrel 50 of the firearm) while adjustment ring 504 may protrude radially around the circumference of barrel 50 of the firearm when adjustable gas system 20 is installed on barrel 50 of the firearm. Shaft lip 501 may be where gas port holes 502 are located. Shaft lip 501 may be received in cavity 403 of gas block 400. Shaft lip 501 may be curved to accommodate an outer circumference of barrel 50 of the firearm such that, when adjustable gas system 20 is installed on barrel 50, shaft lip 501 at least partially shrouds around barrel 50 of the firearm. The design of gas regulator 500 keeps the general design shape of the area where a hand of a user would be in contact with gas regulator 500 when adjusting gas regulator 500, while eliminating the need of a large ear portion (e.g., ear portions 204) as in gas regulator 200. This is because barrels from different vendors may not have a barrel diameter after gas regulator 500 to give clearance to an ear portion.

Gas port holes 502 may be holes in different sizes. Plunger nose holes 503 may be corresponding holes configured to receive the nose of plunger 300. The location of each of the plunger nose holes 503 may correspond to a respective one of the gas port holes 502 such that, when a nose of plunger 300 is received in one of the plunger nose holes 503, one of the gas port holes 502 is aligned with gas tube cavity 401 to allow a respective amount of gas to flow from barrel 50 to the gas tube. Adjustment ring 504 may be twisted by a user or operator of the firearm to select which one of gas port holes 502 to be used. Adjustment ring 504 may have grooves thereon to aid gripping by the user or operator of the firearm. The set screw hole 505 is designed to hold gas regulator 500 in place on barrel 50 of the firearm during installation. Together with a slim washer (not shown), set screw hole 505 is vital for an accurate installation of gas regulator 500, so that gas port holes 502 of gas regulator 500 may align with the counterpart on barrel 50 before gas regulator 500 slides into a clamp-on type of gas block (e.g., gas block 400) and be fastened by the one or more clamp socket screws 600 (or before setting the pin for pin-on type of gas block such as gas block 100).

Highlights of Select Features

In one aspect, an adjustable gas system for a firearm may include a gas block, a gas regulator and a plunger. The gas block may be configured to be fixed to a barrel of the firearm, and may include a gas tube cavity configured to receive a gas tube of the firearm. The gas regulator may be configured to rotate around the barrel, and may include a plurality of gas port holes of different sizes. The plunger may be configured to hold the gas regulator at one of a plurality of angles with respect to the gas block such that a select one of the plurality of gas port holes is aligned with the gas tube cavity on the gas block to allow a respective amount of gas to flow from the barrel to the gas tube through the gas tube cavity and the select one of the plurality of gas port holes.

In some implementations, the gas block may also include a cavity configured to receive the gas regulator therein. The gas regulator may be at least partially received in the cavity of the gas block.

In some implementations, the gas regulator may further include a shaft lip on which the plurality of gas port holes are located.

In some implementations, the gas block may also include a plunger hole configured to receive the plunger therein. The gas regulator may further include a plurality of plunger nose holes. Each of the plurality of plunger nose holes may correspond to a respective one of the gas port holes such that, when the plunger is received in the plunger hole on the gas block with a nose of the plunger received in one of the plunger nose holes on the gas regulator, one of the gas port holes is aligned with the gas tube cavity.

In some implementations, a plurality of grooves may be formed on one or more surfaces of the shaft lip and configured to accommodate carbon buildup.

In some implementations, the gas regulator may further include a ring portion and two ear portions. The shaft lip may protrude from the ring portion in a first direction, and the ear portions may protrude from the ring portion in a second direction opposite the first direction.

In some implementations, each of the ear portions may include a plurality of grooves thereon, and the grooves may be configured to accommodate a grip by an operator to twist the gas regulator to rotate around the barrel of the firearm.

In some implementations, each of the ear portions may include one or more holes thereon, and each of the one or more holes may be configured to accommodate a tool used by an operator to twist the gas regulator to rotate around the barrel of the firearm.

In some implementations, each of the ear portions may include a plurality of grooves thereon, and each of the ear portions may also include a plurality of holes located in the grooves. The grooves may be configured to accommodate a grip by an operator to twist the gas regulator to rotate around the barrel of the firearm. Each of the plurality of holes may be configured to accommodate a tool used by an operator to twist the gas regulator to rotate around the barrel of the firearm.

In some implementations, the plunger may include a steel plunger that is spring loaded and retractably received in the plunger hole on the gas block.

In another aspect, an apparatus may include a firearm and an adjustable gas system. The firearm may include at least a barrel and a gas tube. The adjustable gas system may be mounted on the barrel, and may include a gas block, a gas regulator and a plunger. The gas block may be configured to be fixed to a barrel of the firearm, and may include a gas tube cavity configured to receive a gas tube of the firearm. The gas regulator may be configured to rotate around the barrel, and may include a plurality of gas port holes of different sizes. The plunger may be configured to hold the gas regulator at one of a plurality of angles with respect to the gas block such that a select one of the plurality of gas port holes is aligned with the gas tube cavity on the gas block to allow a respective amount of gas to flow from the barrel to the gas tube through the gas tube cavity and the select one of the plurality of gas port holes.

In some implementations, the gas block may also include a cavity configured to receive the gas regulator therein. The gas regulator may be at least partially received in the cavity of the gas block.

In some implementations, the gas regulator may further include a shaft lip on which the plurality of gas port holes are located.

In some implementations, the gas block may also include a plunger hole configured to receive the plunger therein. The gas regulator may further include a plurality of plunger nose holes. Each of the plurality of plunger nose holes may correspond to a respective one of the gas port holes such that, when the plunger is received in the plunger hole on the gas block with a nose of the plunger received in one of the plunger nose holes on the gas regulator, one of the gas port holes is aligned with the gas tube cavity.

In some implementations, a plurality of grooves may be formed on one or more surfaces of the shaft lip and configured to accommodate carbon buildup.

In some implementations, the gas regulator may also include an adjustment ring. The shaft lip may protrude from the ring portion in a longitudinal direction with respect to the barrel of the firearm when the gas regulator is mounted on the barrel, and the adjustment ring may protrude radially with respect to the barrel of the firearm when the gas regulator is mounted on the barrel.

In some implementations, the adjustment ring may include a plurality of grooves thereon. The grooves may be configured to accommodate a grip by an operator to twist the gas regulator to rotate around the barrel of the firearm.

In some implementations, the gas block may also include a clamp body cutout that provides clearance for the one or more clamp socket screws to fasten the gas block onto the barrel of the firearm.

In some implementations, the gas block may further include a stress-relief slot configured to minimize deformation of the gas block due to a force introduced by fastening of the one or more clamp socket screws.

In some implementations, the plunger may include a steel plunger that is spring loaded and retractably received in the plunger hole on the gas block.

Additional Notes

It will be apparent to those skilled in the art that various modifications and variations can be made to the structure of the present disclosure without departing from the adjustable gas system or spirit of the present disclosure. Moreover, although examples given in the present disclosure are directed to firearms and usage of the proposed adjustable gas system for firearms, there is no limit on the applications of embodiments of the adjustable gas system disclosed herein. That is, any suitable implementation or application using an embodiment of the present disclosure, or variation thereof, is still within the scope of the present disclosure. In view of the foregoing, it is intended that the present disclosure cover modifications and variations of the present disclosure in view of the scope of the following claims and their equivalents.

What is claimed is:

1. An adjustable gas system implementable on a firearm, comprising:

a gas block configured to be fixed to a barrel of the firearm, a first side of the gas block comprising a gas tube cavity configured to receive a gas tube of the firearm;

a gas regulator configured to rotate around the barrel, the gas regulator comprising a plurality of gas port holes of different sizes; and a plunger configured to hold the gas regulator at one of a plurality of angles with respect to the gas block such that a select one of the plurality of gas port holes is aligned with the gas tube cavity on the gas block to allow a respective amount of gas to flow from the barrel to the gas tube through the gas tube cavity and the select one of the plurality of gas port holes, wherein the gas block further comprises a plunger hole on the first side of the gas block, the plunger hole configured to receive the plunger therein, and wherein the plunger is spring loaded and retractably received in the plunger hole on the gas block such that the gas regulator is rotatable around the barrel with the gas block fixed on the barrel.

2. The adjustable gas system of claim 1, wherein the gas block further comprises a cavity configured to receive the gas regulator therein, and wherein the gas regulator is at least partially received in the cavity of the gas block.

3. The adjustable gas system of claim 2, wherein the gas regulator further comprises a shaft lip on which the plurality of gas port holes are located.

4. The adjustable gas system of claim 3, wherein the gas regulator further comprises a plurality of plunger nose holes, and wherein each of the plurality of plunger nose holes corresponds to a respective one of the gas port holes such that, when the plunger is received in the plunger hole on the gas block with a nose of the plunger received in one of the plunger nose holes on the gas regulator, one of the gas port holes is aligned with the gas tube cavity.

5. The adjustable gas system of claim 3, wherein a plurality of grooves are formed on one or more surfaces of the shaft lip and configured to accommodate carbon buildup.

6. The adjustable gas system of claim 3, wherein the gas regulator further comprises a ring portion and two ear portions, wherein the shaft lip protrudes from the ring portion in a first direction, and wherein the ear portions protrude from the ring portion in a second direction opposite the first direction.

7. The adjustable gas system of claim 6, wherein each of the ear portions comprises a plurality of grooves thereon, and wherein the grooves are configured to accommodate a grip by an operator to twist the gas regulator to rotate around the barrel of the firearm.

8. The adjustable gas system of claim 6, wherein each of the ear portions comprises one or more holes thereon, and wherein each of the one or more holes is configured to accommodate a tool used by an operator to twist the gas regulator to rotate around the barrel of the firearm.

9. The adjustable gas system of claim 6, wherein each of the ear portions comprises a plurality of grooves thereon, wherein each of the ear portions further comprises a plurality of holes located in the grooves, wherein the grooves are configured to accommodate a grip by an operator to twist the gas regulator to rotate around the barrel of the firearm, and wherein each of the plurality of holes is configured to accommodate a tool used by an operator to twist the gas regulator to rotate around the barrel of the firearm.

10. The adjustable gas system of claim 1, wherein the plunger comprises a steel plunger.

11. An adjustable gas system implementable on a firearm, comprising:

a gas block configured to be fixed to a barrel of the firearm, a first side of the gas block comprising a gas tube cavity configured to receive a gas tube of the firearm;

a gas regulator configured to rotate around the barrel, the gas regulator comprising a plurality of gas port holes of different sizes;

a plunger configured to hold the gas regulator at one of a plurality of angles with respect to the gas block such that a select one of the plurality of gas port holes is aligned with the gas tube cavity on the gas block to allow a respective amount of gas to flow from the barrel to the gas tube through the gas tube cavity and the select one of the plurality of gas port holes; and one or more clamp socket screws, wherein the gas block has one or more socket screw head clearance holes and corresponding one or more threaded holes, wherein the adjustable gas system is secured on the barrel of the firearm with the one or more clamp socket screws fastened in the one or more threaded holes through the one or more socket screw head clearance holes, wherein the gas block further comprises a plunger hole on the first side of the gas block, the plunger hole configured to receive the plunger therein, and wherein the plunger is spring loaded and retractably received in the plunger hole on the gas block such that the gas regulator is rotatable around the barrel with the gas block fixed on the barrel.

12. The adjustable gas system of claim 11, wherein the gas block further comprises a cavity configured to receive the gas regulator therein, and wherein the gas regulator is at least partially received in the cavity of the gas block.

13. The adjustable gas system of claim 12, wherein the gas regulator further comprises a shaft lip on which the plurality of gas port holes are located.

14. The adjustable gas system of claim 13, wherein the gas regulator further comprises a plurality of plunger nose holes.

15. The adjustable gas system of claim 14, wherein each of the plurality of plunger nose holes corresponds to a respective one of the gas port holes such that, when the plunger is received in the plunger hole on the gas block with a nose of the plunger received in one of the plunger nose holes on the gas regulator, one of the gas port holes is aligned with the gas tube cavity.

16. The adjustable gas system of claim 13, wherein the gas regulator further comprises an adjustment ring, wherein the shaft lip protrudes from the ring portion in a longitudinal direction with respect to the barrel of the firearm when the gas regulator is mounted on the barrel, and wherein the adjustment ring protrudes radially with respect to the barrel of the firearm when the gas regulator is mounted on the barrel.

17. The adjustable gas system of claim 16, wherein the adjustment ring comprises a plurality of grooves thereon, and wherein the grooves are configured to accommodate a grip by an operator to twist the gas regulator to rotate around the barrel of the firearm.

18. The adjustable gas system of claim 11, wherein the gas block further comprises a clamp body cutout that provides clearance for the one or more clamp socket screws to fasten the gas block onto the barrel of the firearm.

19. The adjustable gas system of claim 18, wherein the gas block further comprises a stress-relief slot configured to minimize deformation of the gas block due to a force introduced by fastening of the one or more clamp socket screws.

20. The adjustable gas system of claim 11, wherein the plunger comprises a steel plunger.

* * * * *